US008513570B2

(12) United States Patent
Haussner et al.

(10) Patent No.: US 8,513,570 B2
(45) Date of Patent: Aug. 20, 2013

(54) CERAMIC GLOW PLUG

(75) Inventors: Michael Haussner, Benningen (DE); Helmut Müller, Hessigheim (DE); Martin Allgaier, Ludwigsburg (DE); Rainer Hain, Steinheim (DE)

(73) Assignee: Borg Warner BERU Systems GmbH, Ludwigsburg (DE)

( * ) Notice: Subject to any disclaimer, the term of this patent is extended or adjusted under 35 U.S.C. 154(b) by 593 days.

(21) Appl. No.: 12/715,185

(22) Filed: Mar. 1, 2010

(65) Prior Publication Data

US 2010/0224613 A1 Sep. 9, 2010

(30) Foreign Application Priority Data

Mar. 3, 2009 (DE) ..... 10 2009 011 415

(51) Int. Cl.
*F23Q 7/22* (2006.01)

(52) U.S. Cl.
USPC ..... 219/267; 219/270

(58) Field of Classification Search
USPC ..... 219/267, 270
See application file for complete search history.

(56) References Cited

U.S. PATENT DOCUMENTS

| | | | | |
|---|---|---|---|---|
| 5,084,607 | A | 1/1992 | Shafer | |
| 6,326,595 | B2 * | 12/2001 | Taniguchi et al. | 219/270 |
| 6,831,253 | B2 * | 12/2004 | Taniguchi et al. | 219/270 |
| 2002/0144990 | A1 | 10/2002 | Haussner et al. | |
| 2002/0153365 | A1 | 10/2002 | Taniguchi et al. | |
| 2005/0274707 | A1 | 12/2005 | Matsubara et al. | |
| 2006/0011602 | A1 | 1/2006 | Konishi et al. | |
| 2006/0032472 | A1 | 2/2006 | Yamada et al. | |
| 2006/0254560 | A1 | 11/2006 | Mann et al. | |
| 2009/0321408 | A1 | 12/2009 | Kern et al. | |

FOREIGN PATENT DOCUMENTS

| | | | |
|---|---|---|---|
| DE | 100 29 004 | A1 | 12/2000 |
| DE | 103 22 126 | A1 | 12/2004 |
| DE | 10 2005 029 838 | A1 | 1/2007 |
| JP | 58210412 | A | 7/1983 |
| WO | WO 2007/096208 | A1 | 8/2007 |
| WO | WO 2008/074547 | A1 | 6/2008 |

* cited by examiner

*Primary Examiner* — Stephen W Smoot

(57) ABSTRACT

The present invention refers to a glow plug comprising a ceramic glow pencil (1), a protective tube (2) enclosing the glow pencil (1), a plug body (3) from which the protective tube (2) projects and a sleeve (4), which encloses the protective tube (2) and which is welded to the protective tube (2), is fitted in the plug body (3).

15 Claims, 4 Drawing Sheets

CERAMIC GLOW PLUG

The present invention relates to a glow plug having the features defined in the preamble of claim 1. A glow plug of that kind has been known for example from DE 103 22 126 A1 or from DE 100 29 004 A1.

From DE 103 22 126 A1 it has been known to weld the protective tube, which encloses the glow pencil, to the plug body. However, since different demands are placed on the protective tube and the plug body, normally different materials are used for those two elements so that welding is not unproblematic. Further, it is a disadvantage of the known solution that the weld may attack any surface protection of the plug body.

From DE 100 29 004 A1 it has been further known to fit the protective tube, with the glow pencil arranged in it, in the plug body by a pressing-in process. It is a disadvantage of that solution that the glow pencil may easily be damaged by the pressing-in process.

DE 100 29 004 A1 further mentions the possibility to fix the protective tube on the plug body by means of hard solder. However, that process is very complicated and in addition it leads to relatively large positional inaccuracies.

The invention therefore has for its object to show a way in which the protective tube of a ceiramic glow pencil can be connected with the plug body of a glow plug at little expense.

SUMMARY OF THE INVENTION

The invention achieves that object by a glow plug having the features specified in claim 1. Advantageous further developments of the invention are the subject-matter of the subclaims.

In the case of a glow plug according to the invention a sleeve is fitted in the plug body, which encloses the protective tube and is welded to the protective tube. In this way, one can benefit of the advantages of different connecting techniques, while avoiding their disadvantages.

For example, the sleeve may be pressed into the plug body, and the protective tube with the ceramic glow pencil may then be fitted in the sleeve. The process of pressing-in the sleeve is not connected with any risk of damage to the ceramic glow pencil. Welding the protective tube to the sleeve later, when the protective tube has been fitted together with the glow pencil, can be effected without any difficulty as a suitable material can be selected for the sleeve without any difficulty, or the sleeve and the protective tube can be made from the same material.

An advantageous further development of the invention provides that a portion of the sleeve, which is welded to the protective tube, projects from the plug body. It is especially preferred in that case if the wall thickness of the sleeve is thinner over the portion that projects from the plug body than over a portion enclosed by the plug body. For, a thinner wall thickness provides the advantage of facilitating welding of the sleeve to the enclosed portion of the plug body. On the other hand, a greater wall thickness over a portion enclosed by the plug body provides the advantage of increasing the mechanical stability of the sleeve so that the process of pressing the sleeve into the plug body is facilitated.

Another advantageous further development of the invention provides that an annular gap exists between the protective tube and the plug body. Preferably, an annular gap also exists between the protective tube and a portion of the sleeve which is enclosed by the plug body. These features provide the advantage that heat dissipation from the glow pencil to the plug body can be reduced.

Preferably, the sleeve has a circumferential step. Such a step may, for example, serve to connect a thinner portion of the sleeve, which is welded to the protective tube, with a thicker portion arranged in the plug housing. Especially, a circumferential step may also be used to increase the inner diameter of the sleeve so that an annular gap is obtained between the protective tube and the portion of the sleeve enclosed by the plug body.

Another advantageous further development of the invention provides that the protective tube gets narrower on its end remote from the plug body. It is possible in this way to have the protective tube embrace a tapering portion of the glow pencil and to prevent that in case of breakage the glow pencil might drop into the combustion chamber.

According to another advantageous further development of the invention, the protective tube is provided with openings in its cylindrical surface. This advantageously allows turbulences to be produced in a cylinder head bore which help prevent soot from forming between the cylinder head and the glow pencil with its protective tube. The openings may be configured, for example, as bores, slots, folded-up elements or oblong holes. That aspect of the invention may also be of independent importance. The present invention therefore also relates to a glow plug with a ceramic glow pencil, a protective tube enclosing the glow pencil, and a plug body from which the protective tube projects, where the protective tube is provided with openings in its cylindrical surface.

Another advantageous further development of the invention provides that the protective tube comprises at least two portions in which a gap exists between the protective tube and the glow pencil, the protective tube having a bottleneck between the two portions where it is in contact with the glow pencil. The bottleneck may, for example, extend all around the protective tube, or may be formed by a plurality of embossed areas distributed along the periphery. By having the protective tube contact the glow pencil in one or more areas only, not over its full length, natural oscillation of the glow pencil can be effectively damped. That aspect of the invention may also be of independent importance. The present invention therefore also relates to a glow plug with a ceramic glow pencil, a protective tube enclosing the glow pencil, and a plug body from which the protective tube projects, the protective tube having at least two portions where a gap exists between the protective tube and the glow pencil, and the protective tube having a bottleneck between the two portions where it is in contact with the glow pencil.

According to another advantageous further development of the invention, the protective tube has a rounded inner edge at its end remote from the plug body from which the glow pencil projects. That feature considerably reduces the risk of breakage of the ceramic glow pencil. For, during assembly, or during operation of the engine, the glow pencil may accidentally be pressed against the inner edge of the protective tube. Rounding the inner edge considerably helps to reduce the mechanical loading produced in that case and, consequently, to reduce the risk of breakage. That aspect of the invention may also be of independent importance. The present invention therefore also relates to a glow plug with a ceramic glow pencil, a protective tube enclosing the glow pencil, and a plug body from which the protective tube projects, the protective tube being provided with a rounded inner edge at its end remote from the plug body.

Another advantageous development of the invention provides that the plug body is provided with a coated surface. For example, the plug body may be provided with a catalytic layer on its outside to help burn off any soot that may have formed. Suited as catalysts are, for example, platinum materials.

There is also the possibility to provide the outside of the protective tube with a nonstick coating, for example a nano surface treatment. This is an effective way of counteracting the deposition of soot and of other combustion residues. Nonstick coatings, which simultaneously have a catalytic effect, are of special advantage. Advantageously, the inside of the plug protective tube likewise be coated, especially in the areas where it gets into contact with the glow pencil, for example for damping the contact pressure exerted on the glow pencil. That aspect of the invention may also be of independent importance. The present invention therefore also relates to a glow plug with a ceramic glow pencil, a protective tube enclosing the glow pencil, and a plug body from which the protective tube projects, the protective tube being provided with a coated surface.

Another advantageous further development of the invention provides that the protective tube is electrically insulated from the plug body. This may be achieved, for example, by an arrangement where the portion of the sleeve that projects into the plug body is enclosed by a ceramic ring or a ceramic sleeve so that electric contact between the protective tube and the plug body is prevented. When the protective tube is electrically insulated from the plug body it can be used also for measuring and/or monitoring functions, for example as an ionization electrode or as a temperature sensor, especially when the protective tube is configured as a laboratory resistor or as a thermocouple. That aspect of the invention may also be of independent importance. The present invention therefore also relates to a glow plug with a ceramic glow pencil, a protective tube enclosing the glow pencil, and a plug body from which the protective tube projects, where the protective tube is electrically insulated from the plug body.

Another advantageous further development of the invention provides that the protective tube has a greater wall thickness over a portion that is welded to the sleeve than over a portion that is enclosed by the plug body. A greater wall thickness provides the advantage that welding to the sleeve is facilitated. Further, a step may be formed by the transition from the greater wall thickness to the smaller wall thickness on the outside of the protective tube, which step during assembly may cooperate with a stop on the sleeve or on the plug body to define the position of the protective tube.

Another advantageous further development of the invention provides that the sleeve comprises a peripheral step. Preferably, the step is arranged flush with an end face of the plug body in that case.

BRIEF DESCRIPTION OF THE DRAWINGS

Further details and advantages of the invention will be described hereafter with reference to certain embodiments and to the attached drawings. Identical or similar parts are identified in the drawings by identical reference numerals. In the drawings.

DETAILED DESCRIPTION

Figure 1:
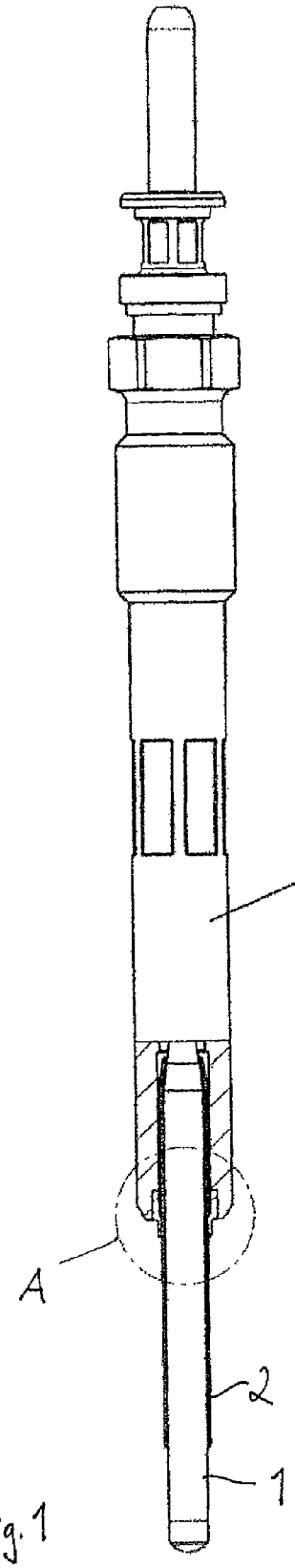
FIG. 1 shows an embodiment of a glow plug according to the invention.

FIG. 1 shows a glow plug with a ceramic glow pencil 1, a protective tube 2 enclosing the glow pencil 1, and a plug body 3 from which the protective tube 2 projects. The protective tube 2 is enclosed by a sleeve 4 which is fitted in the plug body 3 and is welded to the protective tube 2 in an area S that projects from the plug body 3. This can be seen especially well in FIG. 2 which shows an enlarged view of the detail A of FIG. 1.

Figure 2:
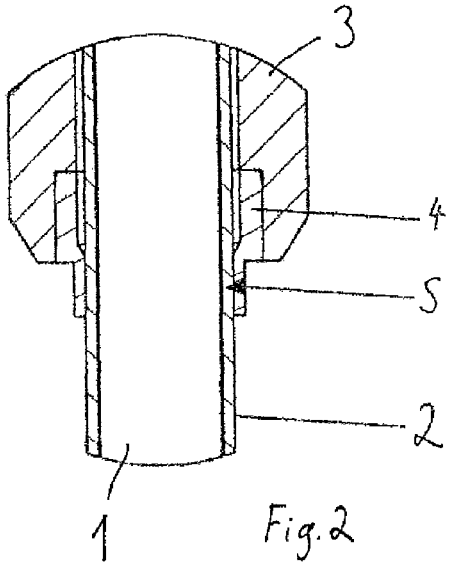
FIG. 2 shows a view of a detail of FIG. 1.

The sleeve 4 is fitted in the plug body 3 by a pressing-in process. The plug body 3 forms a stop for the end of the sleeve 4. As can be seen in FIG. 2, a portion of the sleeve 4, that has a greater wall thickness, is enclosed by the plug body 3. A portion of the sleeve 4, having a smaller wall thickness, projects from the plug body 3 and is welded to the enclosed portion of the protective tube 2, for example by a radial circumferential laser weld. Between those two portions, the sleeve 4 comprises a circumferential step arranged flush with the end face of the plug body 3. Both ends of the protective tube 2 protrude from the sleeve 4.

The sleeve 4 may be made from the same material as the protective tube 2 so that the sleeve 4 and the protective tube 2 can easily be welded one to the other. The plug body 3 preferably consists of a different material, especially from a stainless steel material that is especially well suited for machining, for example from 11SMnPbBiTe30+C. The plug body 3 may be provided with a protective layer on its surface.

Preferably, an annular gap exists between the protective tube 2 and the plug body 3 to reduce heat dissipation from the glow pencil 1 to the plug body 3. Preferably, an annular gap also exists between the portion of the sleeve 4, that is enclosed by the plug body 3, and the protective tube 2, as can be seen in FIG. 2.

Figure 3:
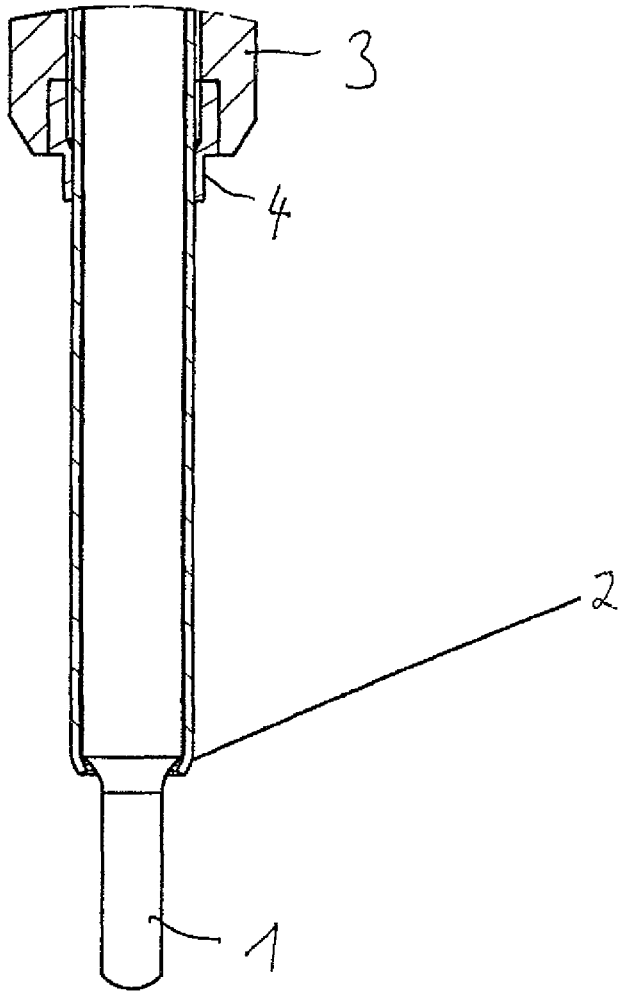
FIG. 3 shows a view of a detail of another embodiment.

FIG. 3 shows a diagrammatic representation of another embodiment of a glow plug. That embodiment differs from the embodiment illustrated in FIG. 1 essentially in that the protective tube 2 gets narrower on its end remote from the plug body 3 and embraces a tapering portion of the glow pencil 1. In case of breakage of the glow pencil the protective tube 2 can posiLively hold the glow pencil 1 in that case.

Figure 4:
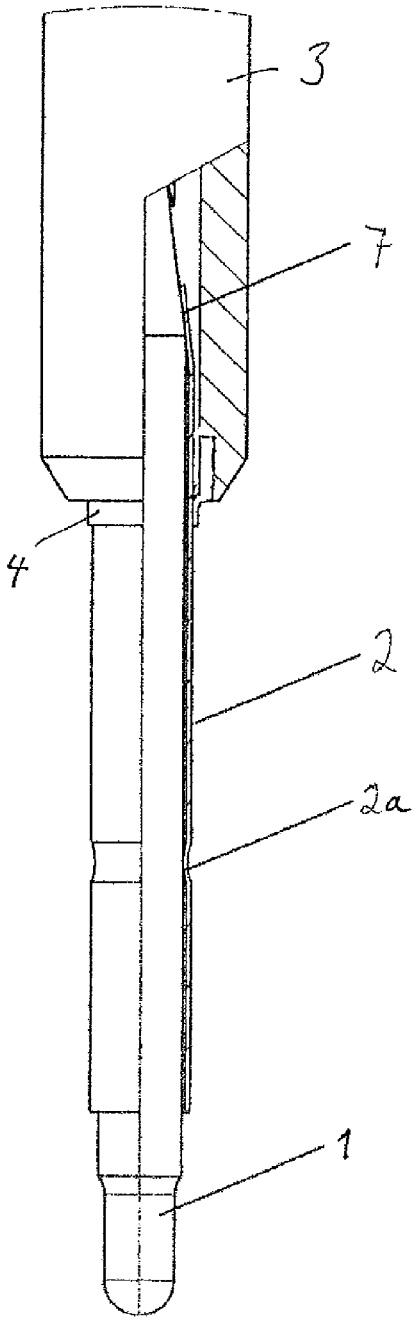
FIG. 4 shows a diagrammatic representation, sectioned in part, of another embodiment.

FIG. 4 shows a diagrammatic representation of another embodiment of a glow plug. In the case of that embodiment, the protective tube 2 comprises two portions in which a gap exists between the protective tube 2 and the glow pencil 1. Between those two portions, the protective tube 2 has a bottleneck 2*a* where it is in contact with the glow pencil 1. Any natural vibration of the glow pencil 1 can be effectively damped in that way. The end of the protective tube 2 arranged in the plug body 3, and the glow pencil 1 may be connected, for example, by a soldered connection 7.

Figure 5:
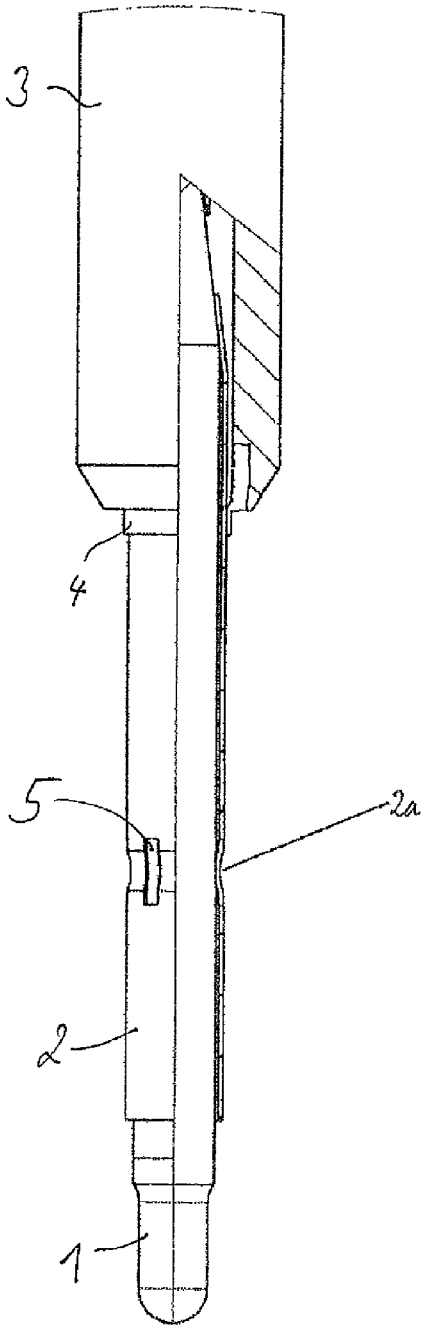
FIG. 5 shows a diagrammatic representation, sectioned in part, of another embodiment.

The bottleneck 2*a* may be realized as a circumferential contraction, as illustrated in FIG. 5. There is also the possibility to provide slots 5 in the area of the bottleneck for adjusting the spring forces by which the protective tube 2 acts on the glow pencil 1 in the area of the bottleneck 2*a*. This is shown by way of example in FIG. 5.

Figure 6:
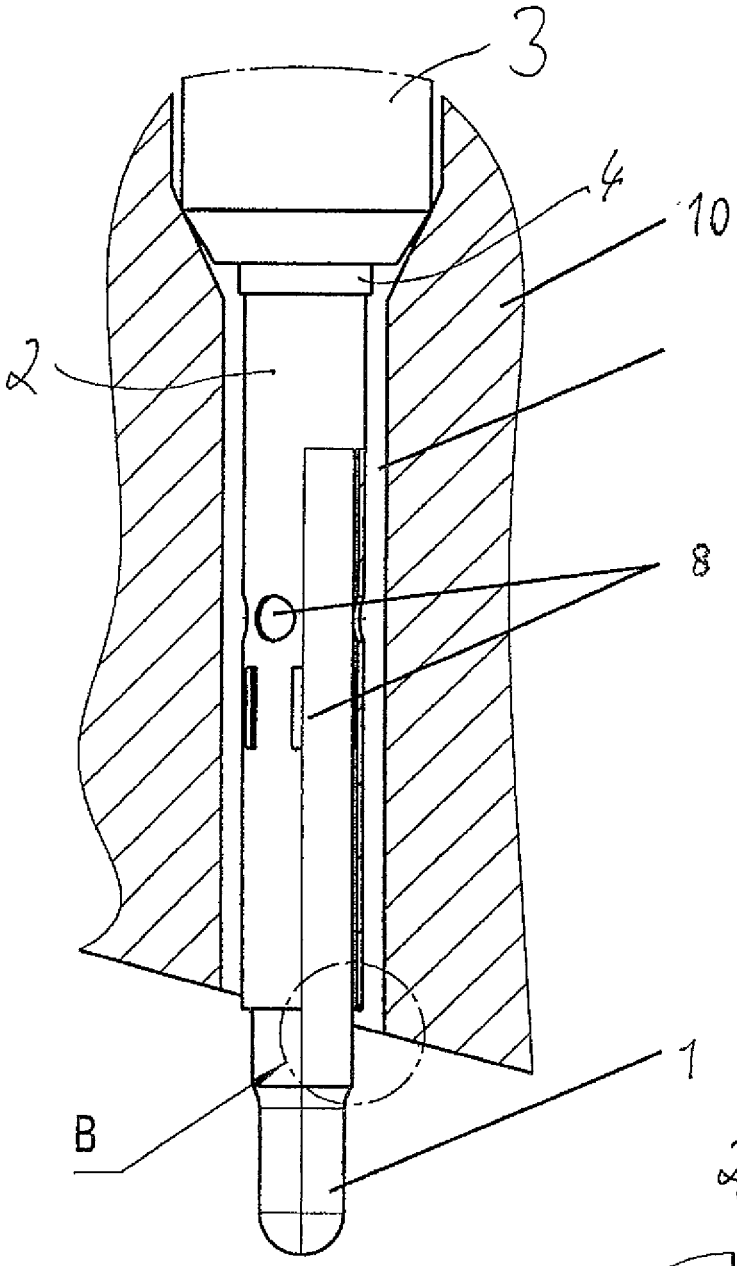
FIG. 6 shows a diagrammatic representation of an embodiment in a cylinder head bore of an engine.

FIG. 6 shows a partially sectioned view of another embodiment of a glow plug in a bore 9 of a cylinder head 10. In the case of that embodiment the protective tube 2 is provided with openings 8 in its cylindrical surface, for example with bores, slots, folded-up elements or oblong holes. Those openings 8 may produce turbulences in the cylinder head bore 9 that help prevent soot from forming.

Figure 7:
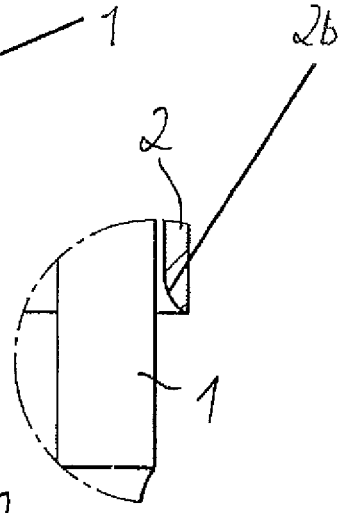
FIG. 7 shows a view of a detail of FIG. 6.

FIG. 7 shows an enlarged view of detail B of FIG. 6. It can be seen in that Figure that the protective tube 2 is provided with a rounded inner edge 2*b* on its end remote from the plug body 3, from which the glow pencil 1 projects. This helps reduce the mechanical loading on the glow pencil 1 during assembly, and the risk of breakage.

The protective tube 2 of the described embodiments may have a coated surface. For example, it may be provided with a catalytic layer and/or a nonstick coat on its outside. A catalytic layer, consisting for example of a platinum material, may help burn off any soot that may have formed. A nonstick coat, for example a nano surface coating, can help prevent depositions of soot or other combustion residues from forming. Inside the tube, the glow pencil 1 may be supported in a vibration-damping fashion by a surface coating, especially a mechanically softer surface coating.

LIST OF REFERENCE NUMERALS

1 Glow pencil
2 Protective tube
2*a* Bottleneck
2*b* Inner edge
3 Plug body
4 Sleeve
5 Slots
7 Soldered connection
8 Openings
9 Bore
10 Cylinder head

What is claimed is:

1. A glow plug comprising:
a ceramic glow pencil;
a protective tube enclosing the glow pencil;
a plug body from which the protective tube projects; and
a sleeve which encloses the protective tube and is welded to the protective tube, wherein the sleeve is fitted in the plug body,
wherein the protective tube projects from the sleeve by its two ends.

2. The glow plug as defined in claim 1, wherein the sleeve is pressfitted into the plug body.

3. The glow plug as defined in claim 1, wherein the sleeve projects from the plug body with a portion that is welded to the protective tube.

4. The glow plug as defined in claim 3, wherein the sleeve has a smaller wall thickness over the portion that projects from the plug body than over a portion enclosed by the plug body.

5. The glow plug as defined in claim 1, wherein the sleeve is provided with a circumferential step.

6. The glow plug as defined in claim 1, wherein an annular gap exists between the protective tube and a portion of the sleeve that is enclosed by the plug body.

7. The glow plug as defined in claim 1, wherein the plug body is provided with a stop for the sleeve.

8. The glow plug as defined in claim 1, wherein the protective tube gets narrower on its end remote from the plug body.

9. The glow plug as defined in claim 1, wherein the protective tube is provided with openings in its cylinder surface.

10. The glow plug as defined in claim 1, wherein the protective tube comprises at least two portions where a gap exists between the protective tube and the glow pencil, the protective tube having a bottleneck between these two portions where it is in contact with the glow pencil.

11. The glow plug as defined in claim 1, wherein an annular gap exists between the plug body and the protective tube.

12. The glow plug as defined in claim 1, wherein the protective tube is provided with a coated surface.

13. The glow plug as defined in claim 1, wherein the protective tube is electrically insulated from the plug body.

14. A glow plug comprising:
a ceramic glow pencil;
a protective tube enclosing the ceramic glow pencil;
a plug body from which the protective tube projects; and
a sleeve enclosing the protective tube,
wherein both the sleeve and the protective tube comprise a weldable material, and
wherein the sleeve and protective tube are joined by a weld, and
wherein the protective tube has a greater thickness over a portion that is welded to the sleeve than over a portion that is enclosed by the plug body.

15. A glow plug comprising:
a ceramic glow pencil;
a protective tube enclosing the ceramic glow pencil, the protective tube formed from a weldable material;
a plug body from which the protective tube projects;
a sleeve enclosing the protective tube, the sleeve also formed from the weldable material; and
a weld joining the sleeve and protective tube.

* * * * *